US008997534B2

(12) United States Patent
Rai et al.

(10) Patent No.: US 8,997,534 B2
(45) Date of Patent: Apr. 7, 2015

(54) PRIVACY OVERRIDE FUNCTION FOR A DOOR LOCK

(75) Inventors: Subashchandra G. Rai, Karnataka (IN); Charan Kumar, Karnataka (IN)

(73) Assignee: Schlage Lock Company LLC, Indianapolis, IN (US)

( * ) Notice: Subject to any disclaimer, the term of this patent is extended or adjusted under 35 U.S.C. 154(b) by 264 days.

(21) Appl. No.: 13/557,333

(22) Filed: Jul. 25, 2012

(65) Prior Publication Data

US 2014/0026627 A1 Jan. 30, 2014

(51) Int. Cl.

| | |
|---|---|
| ***E05B 59/00*** | (2006.01) |
| ***E05B 65/00*** | (2006.01) |
| ***E05C 1/10*** | (2006.01) |

(52) U.S. Cl.

CPC .. *E05B 65/00* (2013.01); *E05C 1/10* (2013.01)

(58) Field of Classification Search

USPC ..... 70/107, 110, 150, 151 R, 472, 486; 292/332, 335, 169.14

See application file for complete search history.

(56) References Cited

U.S. PATENT DOCUMENTS

| | | | | |
|---|---|---|---|---|
| 1,970,757 | A | 8/1934 | Lyons | |
| 3,823,585 | A | 7/1974 | Spon | |
| 4,583,382 | A | 4/1986 | Hull | |
| 5,496,082 | A | 3/1996 | Zuckerman | |
| 6,349,982 | B2 | 2/2002 | Fayngersh et al. | |
| 6,393,878 | B1 | 5/2002 | Fayngersh et al. | |
| 6,543,264 | B2 | 4/2003 | Frolov | |
| 6,578,888 | B1 | 6/2003 | Fayngersh et al. | |
| 6,860,129 | B2 | 3/2005 | Eller et al. | |
| 7,377,140 | B2 * | 5/2008 | Shen et al. | 70/107 |
| 7,497,486 | B1 | 3/2009 | Davis et al. | |
| 8,690,203 | B1 * | 4/2014 | Hickman et al. | 292/244 |
| 2002/0101083 | A1 | 8/2002 | Toledano et al. | |
| 2003/0127864 | A1 | 7/2003 | Dalsing | |
| 2010/0192650 | A1 | 8/2010 | Fowler et al. | |
| 2010/0300161 | A1 | 12/2010 | Lin | |

FOREIGN PATENT DOCUMENTS

| | | |
|---|---|---|
| EP | 0574629 | 12/1993 |
| EP | 1840302 B1 | 9/2011 |
| GB | 890124 | 2/1962 |
| KR | 20080043203 | 5/2008 |

OTHER PUBLICATIONS

ML2000 Series, Mortise Locksets Manual, Corbin Russwin, 2011, Retrieved from the Internet <URL: http://extranet.assaabloydss.com/library/catalogs/CorbinRusswin/pdf/45300.pdf>.

Mortise Lock Functions Price Book, Ingersoll Rand, 2010, pp. L2-L7.

* cited by examiner

*Primary Examiner* — Suzanne Barrett

(74) *Attorney, Agent, or Firm* — Michael Best & Friedrich LLP

(57) ABSTRACT

A door lock includes a deadbolt and a latchbolt each movable between a thrown position and a retracted position, an inside lever operable to move the latchbolt between the thrown and retracted positions, and an outside lever configured in one of a locked and unlocked state in which the outside lever is operable to move the latchbolt between the thrown and retracted position. A thumbturn is coupled to the deadbolt and is movable between a first position in which the deadbolt is in the thrown position, the latchbolt is in the thrown position, and the outside lever is locked, a second position in which the deadbolt is in the retracted position, the latchbolt is in the thrown position, and the outside lever is locked, and a third position in which the deadbolt is in the retracted position, the latchbolt is in the thrown position, and the outside lever is unlocked.

13 Claims, 9 Drawing Sheets

PRIVACY OVERRIDE FUNCTION FOR A DOOR LOCK

BACKGROUND

The present invention relates to door latching and locking mechanisms. More specifically, the present invention relates to an override function for a deadbolt lock.

SUMMARY

In one construction, the invention provides a door lock including a deadbolt and a latch bolt each movable between a thrown position and a retracted position. The lock includes an inside lever operable to move the latch bolt between the thrown position and the retracted position and an outside lever configured in one of a locked state and an unlocked state in which the outside lever is operable to move the latch bolt between the thrown and the retracted position. A thumbturn is coupled to the deadbolt and is movable between a first position in which the deadbolt is in the thrown position, the latchbolt is in the thrown position, and the outside lever is locked, a second position in which the deadbolt is in the retracted position, the latchbolt is in the thrown position, and the outside lever is locked, and a third position in which the deadbolt is in the retracted position, the latchbolt is in the thrown position, and the outside lever is unlocked.

In another construction, the invention provides a door lock for a door including a deadbolt and a latch bolt each movable between a thrown position and a retracted position. The lock includes an inside lever positioned on an inner side of the door and operable to move the latch bolt between the thrown position and the refracted position and an outside lever positioned on an outer side of the door and configured in one of a locked state and an unlocked state in which the outside lever is operable to move the latch bolt between the thrown and the retracted position. A key-mechanism is positioned on the outer side of the door and is movable to transition the lock between a first state, a second state, and a third state, and wherein in the first state, the deadbolt is in the thrown position, the latchbolt is in the thrown position, and the outside lever is locked, in the second state the deadbolt is in the retracted position, the latchbolt is in the thrown position, and the outside lever is locked, and in the third state the deadbolt is in the retracted position, the latchbolt is in the retracted position, and the outside lever is unlocked. A thumbturn is movable from a first position to a second position when the lock is in the third state to transition the outside lever from unlocked to locked.

In yet another construction, the invention provides a door lock for a door having an inside and an outside. The door lock includes a deadbolt movable between a thrown position and a retracted position, a latchbolt movable between a thrown position and a retracted position, a key-mechanism rotatable about a key axis, and a thumbturn positioned on the inside of the door and movable between a first position, a second position, and a third position. An inside lever is positioned on the inside of the door and operable to move the latch bolt between the thrown position and the retracted position and an outside lever positioned on the outside of the door and configured in one of a locked state in which the lever cannot move the latchbolt and an unlocked state in which the outside lever is operable to move the latch bolt between the thrown and the retracted position. The lock is configurable in one of a first state in which the deadbolt is thrown, the latchbolt is thrown, and the outside lever is locked, a second state, in which the deadbolt is retracted, the latchbolt is thrown, and the outside lever is locked, a third state, in which the deadbolt is refracted, the latchbolt is thrown, and the outside lever is unlocked, and a fourth state, in which the deadbolt is retracted, the latchbolt is retracted, and the outside lever is unlocked. With the key-mechanism in a first position, movement of the thumbturn from the first position to the second position transitions the lock from the first state to the second state, and movement of the thumbturn from the second position to the third position transitions the lock from the second state to the third state, and wherein with the thumbturn in the first position, rotation of the key-mechanism a first distance transitions the lock from the first state to the second state, and further rotation of the key-mechanism transitions the lock from the second state to the fourth state.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
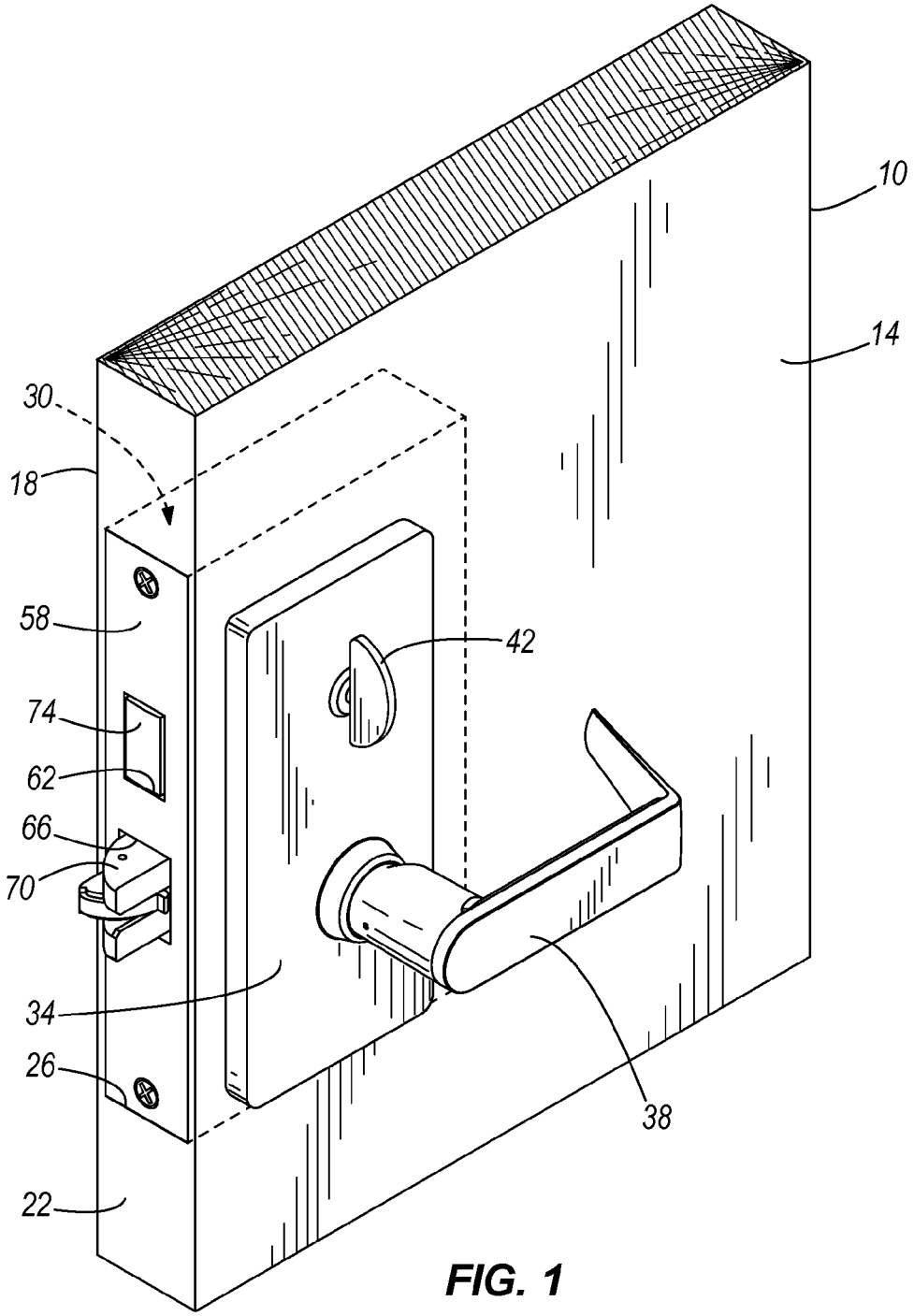
FIG. 1 is a perspective view of an inside surface of a door including a door lock.

Referring to FIG. 1, a door 10 includes an inside (or first) surface 14 and an outside (or second) surface 18 opposite the inside surface. A lateral latch edge 22 extends between the inside surface 14 and the outside surface 18. The latch edge 22 defines a mortise 26 configured to receive a door lock 30.

Externally, the door lock 30 includes an inside cover plate 34 that is coupled to the inside surface 14 of the door 10 as shown in FIG. 1. An inside lever 38 and a thumbturn 42 are rotatably coupled to the cover plate 34. A substantially similar outside cover plate 46 and an outside lever 50 (not shown) are coupled to the outside surface 18 of the door 10 opposite the inside cover plate 34. A key-mechanism 54 (FIG. 9) is provided on the outside cover plate 46, substantially opposite the thumbturn 42.

Referring to FIG. 1, the door lock 30 also includes a face plate 58 that is disposed within the mortise 26, flush with the latch edge 22 of the door 10 and disposed in opposing parallel relationship to a strike (not shown) of a door frame (not shown) when the door 10 is closed. The face plate 58 defines a deadbolt aperture 62 and a latchbolt aperture 66.

Figure 2:
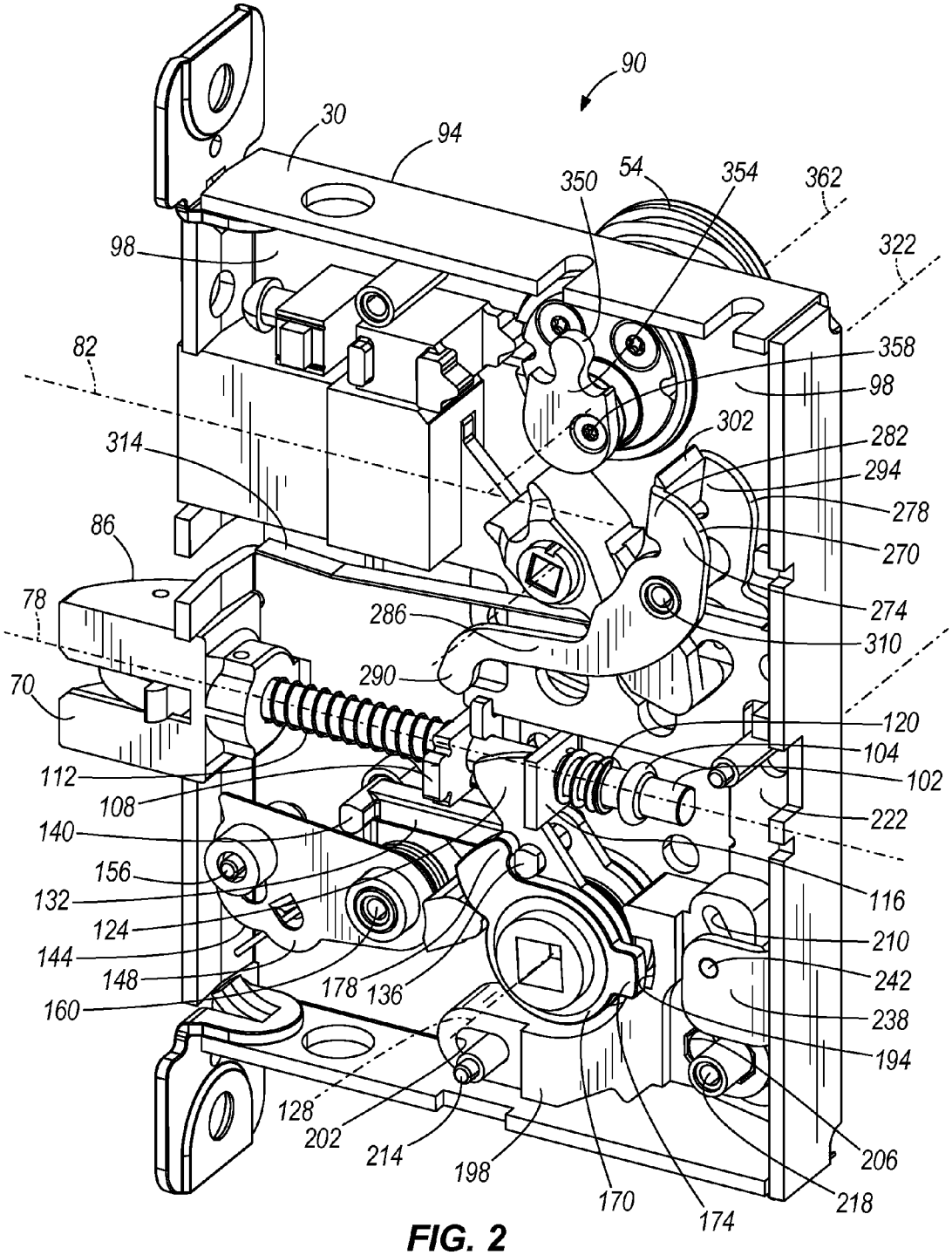
FIG. 2 is a perspective view of the door lock of FIG. 1.

A latchbolt 70 protrudes through the latchbolt aperture 66 and a deadbolt 74 is recessed within the deadbolt aperture 62. Referring to FIG. 2, the latchbolt 70 reciprocates along a latchbolt axis 78 while the deadbolt 74 reciprocates along a deadbolt axis 82. The latchbolt 70 is preferably a generally rectangular member having a short beveled free end 86. The beveled end 86 of the latchbolt 70 engages a strike of the door frame and is forced back into the latchbolt aperture 66 until the door 10 reaches a position in which the latchbolt 70 can project into the latchbolt opening (not shown) in the strike.

As shown in FIG. 2, the latchbolt 70 and deadbolt 74 are slidably coupled to a lock case 90. The lock case 90 includes a substantially rectangular housing 94 with a base wall 98. The base wall 98 provides a mounting surface for various internal components, as well as providing support for mounting the door lock 30 in the mortise 26 of the door 10.

As illustrated in FIG. 2, the latchbolt 70 is fixedly coupled to a throw rod 102. The throw rod 102 extends from the latchbolt 70 to an end flange 104. The throw rod 102 is slidably coupled to a guiding tab 108 that is fixedly coupled to the base wall 98 of the door lock 30. A latchbolt spring 112 is disposed about the throw rod 102 between the latchbolt 70 and the guiding tab 108. An actuating tab 116 is slidably coupled around the throw rod 102 adjacent to the guiding tab 108. A locating spring 120 is disposed about the throw rod 102 between the actuating tab 116 and end flange 104.

Referring to FIG. 2, the door lock 30 includes a pivotally mounted retraction lever 124 pivotally coupled to the lock case 90 about a retraction axis 128 through which the inside lever 38 and the outside lever 50 (not shown) rotate. The retraction lever 124 engages the throw rod 102 via the actuating tab 116. The retraction lever 124 overcomes the bias of the locating spring 120 that urges the latchbolt 70 to the extended position.

Figure 9:
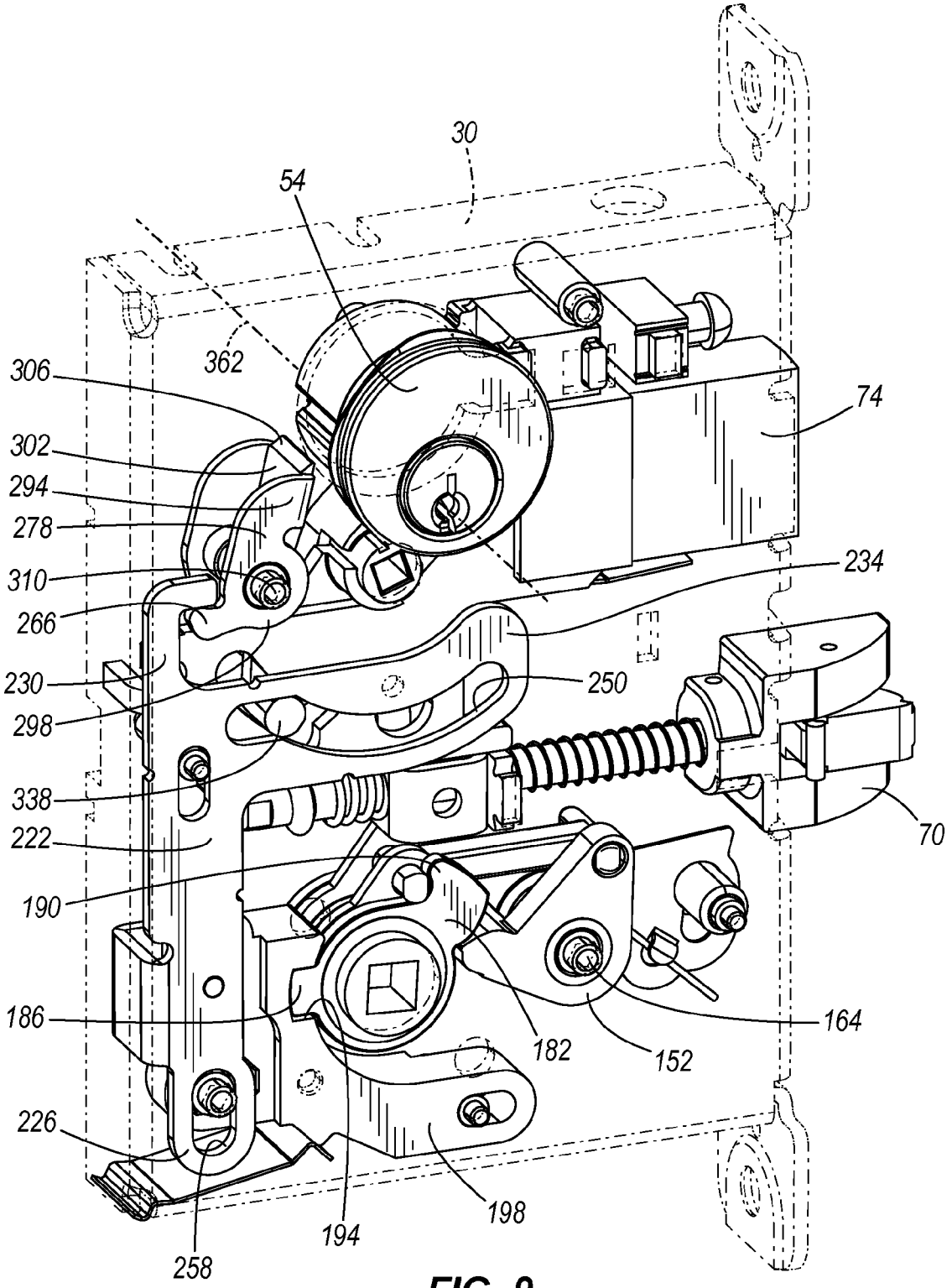
FIG. 9 is an alternative perspective view of the door lock of FIG. 2.

A retraction rod 132 is pivotably coupled to the retraction lever 124. The refraction rod 132 has a first end 136 and a second end 140. The first end 136 is pivotably coupled to the retraction lever 124. The second end 140 is pivotably coupled to a gear member 144. The gear member 144 includes an inside plate 148 and an outside connecting member 152 (FIG. 9). The inside plate 148 is supported by two pivot points 156, 160 while the outside connecting member 152 is rotatable about a single pivot point 164.

The retraction lever 124 is selectively rotatably coupled to an inside connecting link 170. The connecting link 170 is pivotable about the retraction axis 128 by rotation of the inside lever 38. Shown in FIG. 2, the inside connecting link 170 includes an inside locking lug 174 and an inside hook 178. The inside hook 178 is rotatably engaged about the first end 136 of the retraction rod 132.

Similarly, the retraction lever 124 is rotatably coupled to an outside connecting link 182 (FIG. 9). The outside connecting link 182 is pivotable about the retraction axis 128 by rotation of the outside lever 50 (not shown). The outside connecting link 182 includes an outside locking lug 186 and an outside hook 190. The outside hook 190 is rotatably engaged about the first end 136 of the retraction rod 132. The connecting link 170 and the outside connecting link 182 rotate independently from one another about the refraction axis 128.

The outside locking lug 186 is received into a preferably rectangular recess 194 in a displacable locking catch 198 as shown in FIG. 9. The outside locking lug 186 engages in the recess 194 to prevent the outside connecting link 182 from rotating. The connecting link 170 has been removed from FIGS. 3-8 to clearly show the engagement of the outside locking lug 186 with the recess 194.

As shown in FIG. 2, the locking catch 198 includes a first elongated slot 202, a second elongated slot 206, and an oblique slot 210. A first locking catch pivot point 214 and a second locking catch pivot point 218 are coupled to the base wall 98 of the lock case 90. The first elongated slot 202 and the second elongated slot 206 slide axially about the first locking catch pivot point 214 and the second locking catch pivot point 218, respectively. The locking catch 198 is mechanically coupled to a locking link 222 about the second locking catch pivot 218 and the oblique slot 210.

Figure 3:
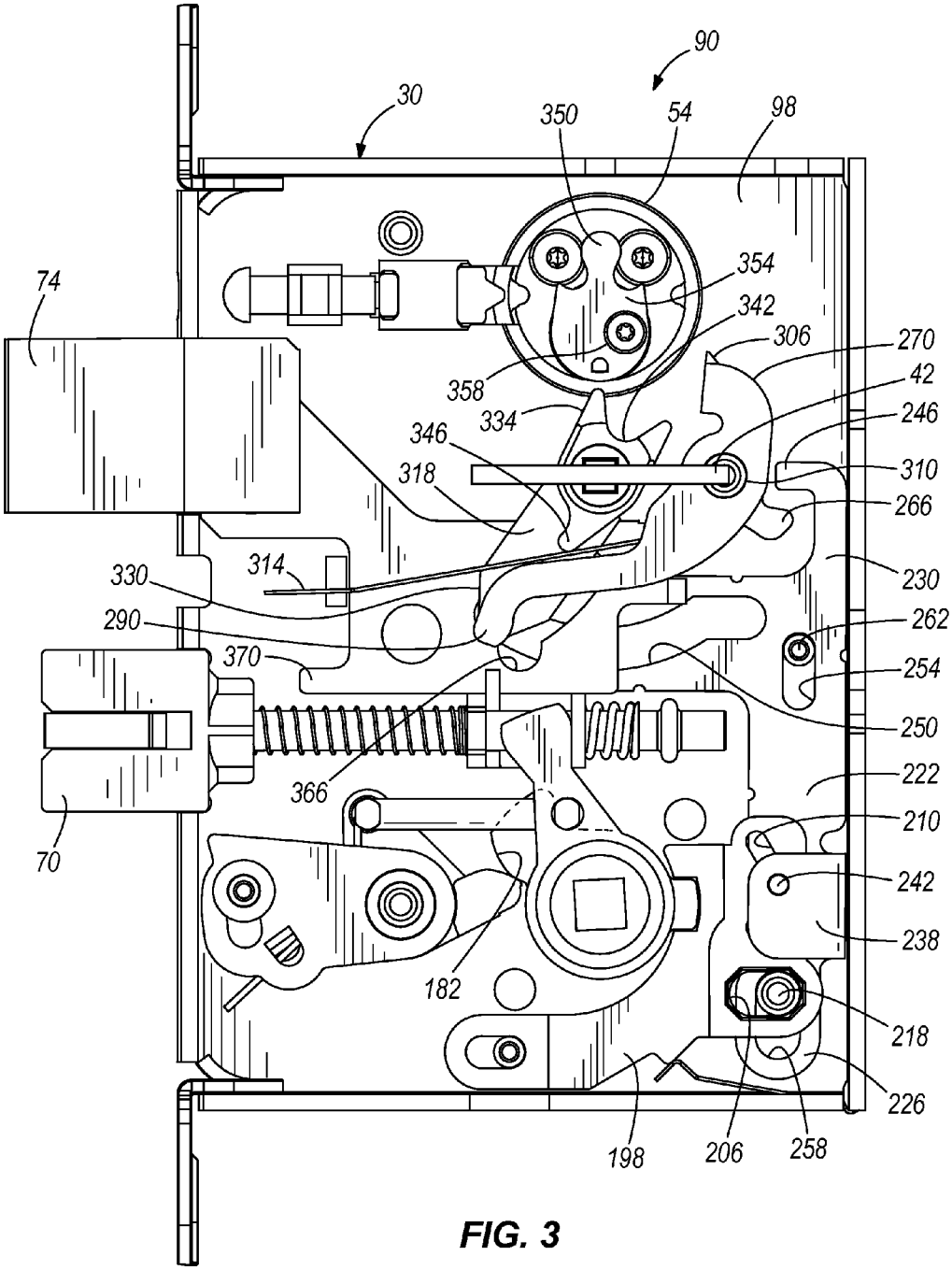
FIG. 3 is front view of the door lock of FIG. 2 in a first position.

The locking link 222, shown in FIG. 3, includes a first end 226, a second end 230, and a third end 234 (FIG. 9). As shown in FIG. 3, the first end 226 includes a clevis 238 having a pin 242, and the second end 230 includes a locking arm 246. The third end 234 includes a curved slot 250 (FIG. 9). The locking link 222, illustrated in FIG. 3, includes a first elongated slot 254 and a second elongated slot 258. A first locking link pivot 262 is coupled to the base wall 98 of the lock case 90. The second elongated slot 206 of the locking catch 198 and the second elongated slot 258 of the locking link 222 are slidable about the second locking catch pivot point 218.

As shown in FIG. 3, the oblique slot 210 in the locking catch 198 cooperates with the pin 242 to translate vertical motion of the locking link 222 into horizontal (as viewed) movement of the locking catch 198. The locking arm 246 of the locking link 222 engages with a lifting arm 266 coupled to a transfer lever 270 to facilitate an unlocking function.

FIG. 2 shows that the transfer lever 270 includes an inside arm 274 and an outside arm 278. The inside arm 274 has a first end (upper as viewed) 282 and a second end (lower as viewed) 286. The second end 286 of the inside arm 274 contains an actuating arm 290. FIG. 9 shows that the outside arm 278 has a first end (upper as viewed) 294 and a second end (lower as viewed) 298. The lifting arm 266 is disposed at the second end 298 of the outside arm 278.

As illustrated in FIG. 2, the first end 282 of the inside arm 274 and the first end 294 of the outside arm 278 are connected with an actuating surface 302. The actuating surface 302 contains an inclined surface 306.

Also referring to FIG. 2, a transfer lever pivot point 310 is fixedly coupled at one end to the base wall 98 of the lock case 90 and is positioned through both the inside arm 274 and the outside arm 278. A resilient member, specifically a leaf spring 314, coils around the transfer lever pivot point 310.

Shown in FIG. 2, the transfer lever 270 rotates about the transfer lever pivot point 310. The actuating arm 290 engages with the actuating tab 116 on the throw rod 102 to retract the latchbolt 70. The leaf spring 314 provides bias to the transfer lever 270.

Referring to FIG. 3, a bistable arm 318 is pivotally mounted for movement about a thumbturn axis 322 (FIG. 2) coupled to the base wall 90. The thumbturn 42, shown in FIG. 3, is fixedly coupled to the thumbturn axis 322 to allow for rotation about the axis 322. The bistable arm 318 includes a first end 330 and a second end 334. The first end 330 includes a laterally extending arm 338 (FIG. 9). The second end 334 (FIG. 3) includes a curved recess 342. One face of the bistable arm 318 includes a biasing arm 346.

The laterally extending arm 338 is dimensioned and configured for engaging the curved slot 250 of the locking link 222 as shown in FIG. 9. As shown in FIG. 3, the biasing arm 346 provides biased engagement with the leaf spring 314 upon thumbturn 42 rotation. The recess 342 cooperates with a circular extremity or a nose 350 of a locking member 354.

Referring to FIG. 3, the locking member 354 is integral to the key-mechanism 54. The locking member 354 is rotatably fixedly coupled about a pivot point 358 along a key axis 362 (FIG. 2) on the inside face of the key-mechanism 54. A key can be inserted into the key-mechanism 54 to rotatably actuate the locking member 354 between a locked and an unlocked position. The nose 350 of the locking member 354 engages with the recess 342 of the bistable arm 318 upon a first counterclockwise rotation of the key to retract the deadbolt 74. A second counterclockwise rotation of the key rotates the nose 350 of the locking member 354 to engage with the inclined surface 306 of the bistable arm 318, thereby retracting the latchbolt 70.

FIG. 3 also illustrates that the laterally extending arm 338 (FIG. 9) of the bistable arm 318 also engages with an oblique slot 366 provided in a deadbolt connector plate 370. The deadbolt connector plate 370 is fixedly coupled to the deadbolt 74 to allow lateral movement of the deadbolt 74 between a thrown and a retracted position. The deadbolt 74 is a preferably a generally rectangular member that slides through the deadbolt aperture 62 (FIG. 1).

FIG. 3 illustrates the door lock 30 in a first position (0 degree thumbturn) wherein the key-mechanism 54 remains in its initial position, and the outside connecting link 182 is in a locked position, and the deadbolt 74 and the latchbolt 70 are in the thrown position. The thumbturn 42 is shown to be in a 0 degree, horizontal (as viewed) position. In this position, the locking arm 246 and the lifting arm 266 are disengaged, and the outside locking lug 186 is engaged with the recess 194 of the locking catch 198 (FIG. 9) to prevent the outside locking link 182 (FIG. 9) from rotating. As shown in FIG. 9, the laterally extending arm 338 is engaged at the far left end (as viewed in FIG. 3) of the curved slot 250.

Figure 4:
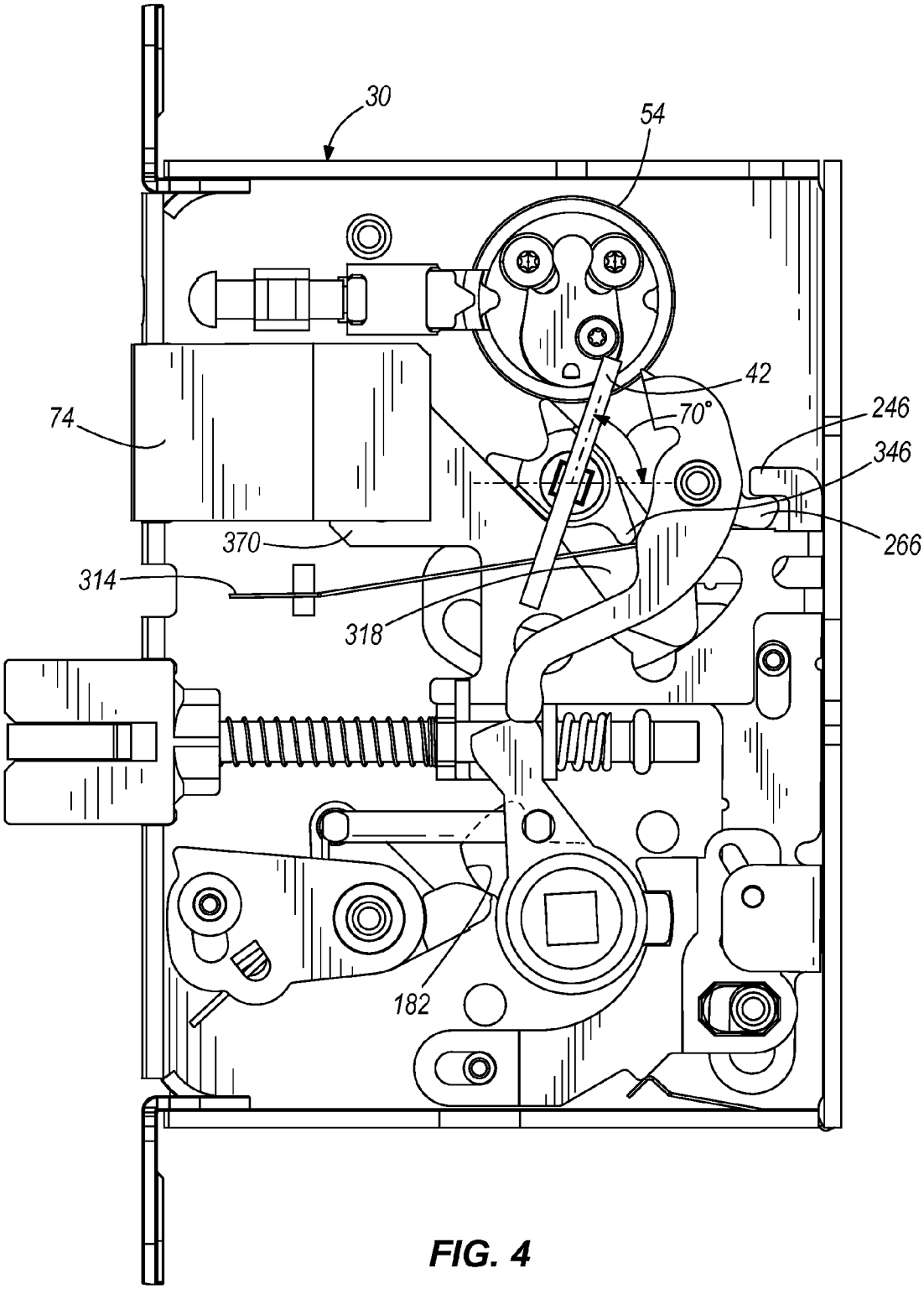
FIG. 4 is front view of the door lock of FIG. 2 in a second position.

Referring to FIG. 4, a 70 degree, pivotal counterclockwise rotation of the thumbturn 42 retracts the deadbolt 74 and defines the second position (70 degree thumbturn) of the door lock 30. The movement of the thumbturn 42 in this position causes the laterally extending arm 338 (FIG. 9) of the bistable arm 318 to slide to the right (as viewed in FIG. 4) within the curved slot 250 while simultaneously retracting the deadbolt connector plate 370 and the deadbolt 74. The biasing arm 346 on the bistable arm 318 forcibly engages the leaf spring 314 upon thumbturn 42 rotation. The key-mechanism 54 remains in its initial position, and the outside connecting link 182 remains in a locked position with the outside locking lug 186 and the recess 194 being engaged (FIG. 9). In this position, the locking arm 246 and the lifting arm 266 are engaged, and the latchbolt 70 remains in the thrown position.

Figure 5:
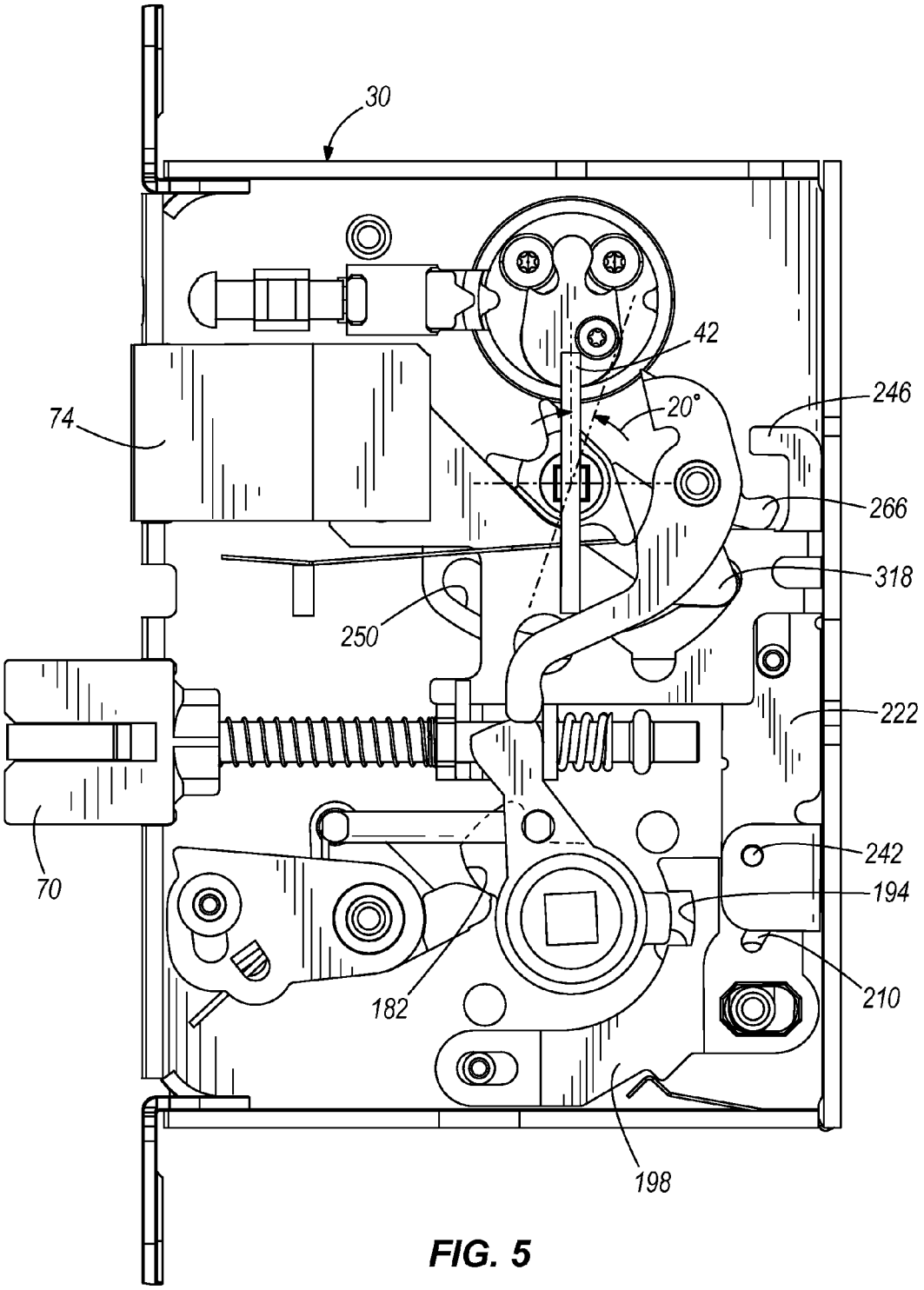
FIG. 5 is front view of the door lock of FIG. 2 in a third position.

Referring to FIG. 5, an additional 20 degree, pivotal counterclockwise rotation of the thumbturn 42 from the second position of FIG. 4, results in the third position of the door lock 30 (90 degree thumbturn) wherein the outside connecting link 182 is in an unlocked position. The 20 degree rotation of the thumbturn 42 causes the laterally extending arm 338 (FIG. 9) of the bistable arm 318 to slide further to the right (as viewed in FIG. 5) within the curved slot 250 of the locking link 222 forcing a vertical movement of the locking link 222. The vertical movement of the locking link 222 causes the locking arm 246 to disengage with the lifting arm 266. The vertical motion of the locking link 222 is translated through the pin 242 in the oblique slot 210 in the locking catch 198 to provide horizontal movement (as viewed) of the locking catch 198. The outside locking lug 186 (FIG. 9) disengages from the recess 194 of the locking catch 198, thus unlocking the outside connecting link 182 by allowing the outside connecting link 182 to freely rotate. In the third position, the key-mechanism 54 remains in its initial position, the deadbolt 74 remains in the retracted position, and the latchbolt 70 remains in the thrown position.

Figure 6:
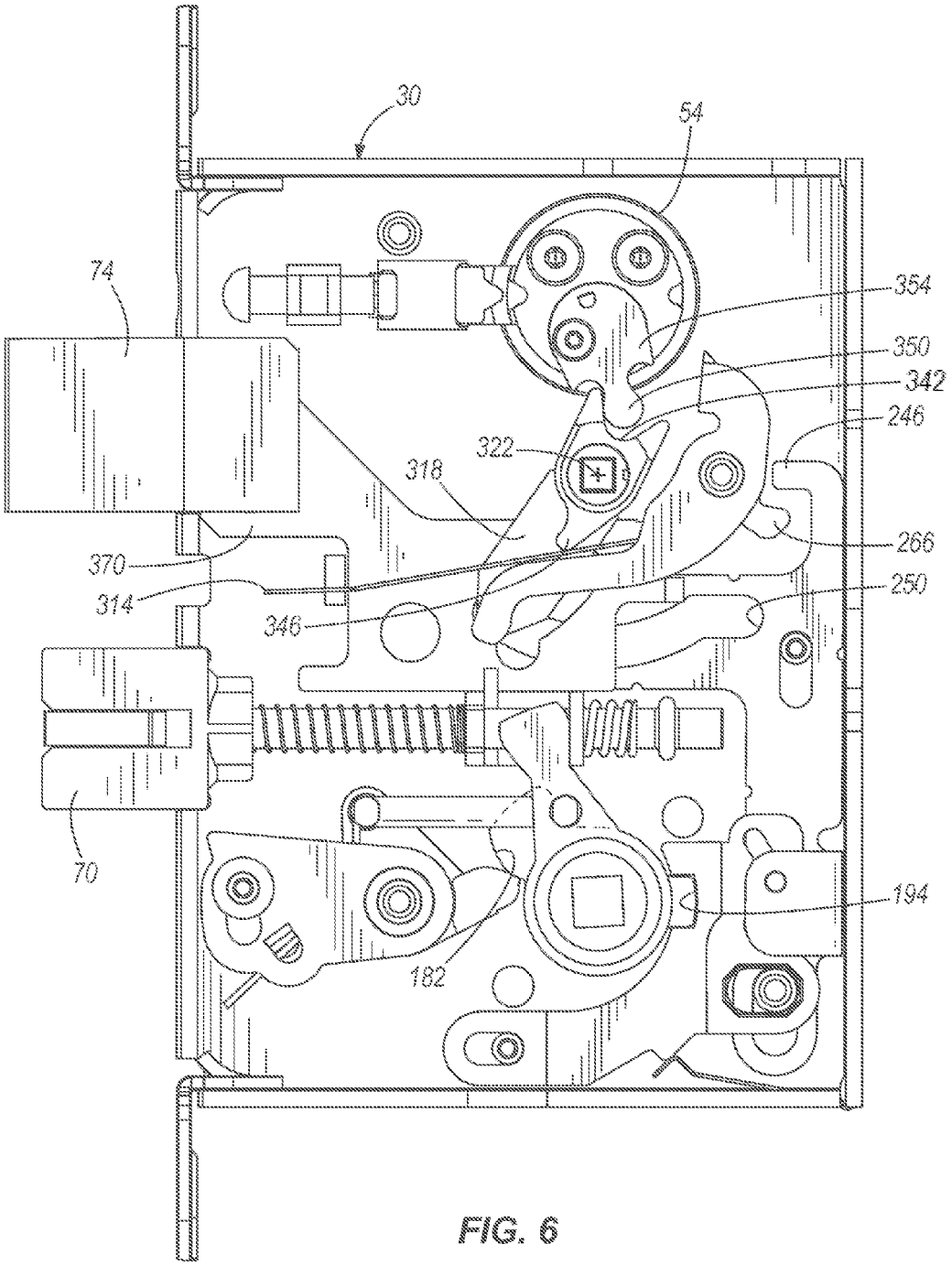
FIG. 6 is front view of the door lock of FIG. 2 in a first state.

FIG. 6 illustrates a first state (half rotation of key) of the door lock 30 in which a key is rotated counterclockwise (as viewed in FIG. 9) one half turn from its initial position within the key-mechanism 54. In the first state, the deadbolt 74 and the latchbolt 70 are in the thrown position, and the outside connecting link 182 is locked. The locking arm 246 and the lifting arm 266 are disengaged, and the outside locking lug 186 (FIG. 9) is engaged with the recess 194 of the locking catch 198. The laterally extending arm 338 (FIG. 9) of the bistable arm 318 is engaged at the far left end (as viewed in FIG. 6) of the curved slot 250.

Figure 7:
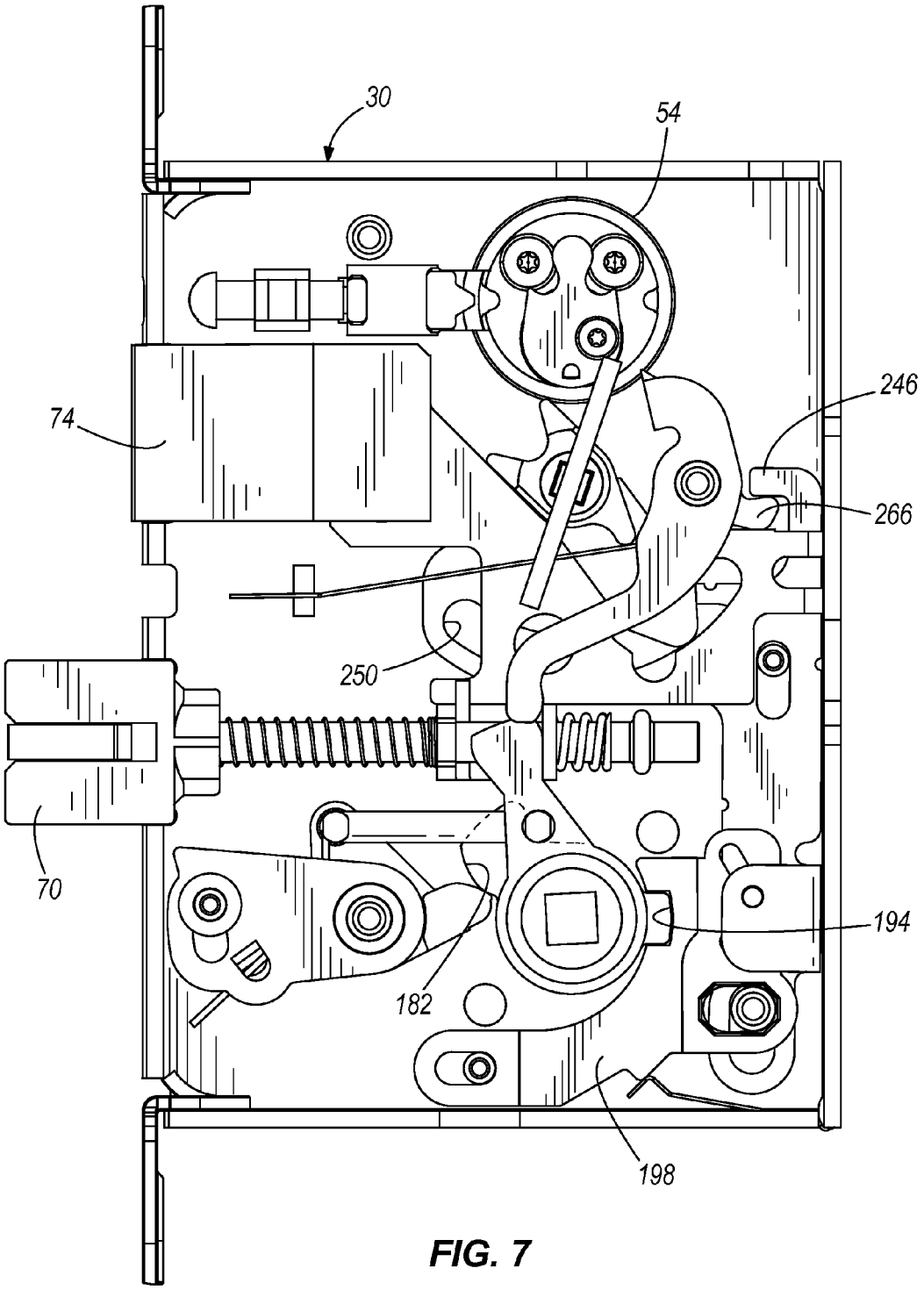
FIG. 7 is front view of the door lock of FIG. 2 in a second state.

The counterclockwise rotation of the key results in a clockwise (as viewed in FIG. 6) rotation of the locking member 354 of the key-mechanism 54, which simultaneously engages the nose 350 with the recess 342 of the bistable arm 318. The engagement of the nose 350 with the recess 342 forces the bistable arm 318 to pivot counterclockwise (as viewed in FIG. 6) about the thumbturn axis 322. The laterally extending arm 338 (FIG. 9) slides to the right (as viewed in FIG. 6) within the curved slot 250 while simultaneously retracting the deadbolt connector plate 370 and the deadbolt 74 as shown in FIGS. 7 and 9. The counterclockwise rotation of the bistable arm 318 in the first state forcibly engages the biasing arm 346 with the leaf spring 314. The outside locking lug 186 (FIG. 9) and the recess 194 remain engaged, thus locking the outside locking link 182.

FIG. 7 shows a second state of the door lock 30 after one full rotation of the key (as viewed in FIG. 9) within the key-mechanism 54. In the second state, the deadbolt 74 is in the retracted position, the latchbolt 70 is in the thrown position, and the outside connecting link 182 is in the locked position. In this state, the locking arm 246 and the lifting arm 266 are engaged, and the outside locking lug 186 is engaged with the recess 194 of the locking catch 198 (FIG. 9). A second rotation of the key from the second state of FIG. 7, results in a third state of the door lock 30 (1.5 rotation of key) shown in FIG. 8.

Figure 8:
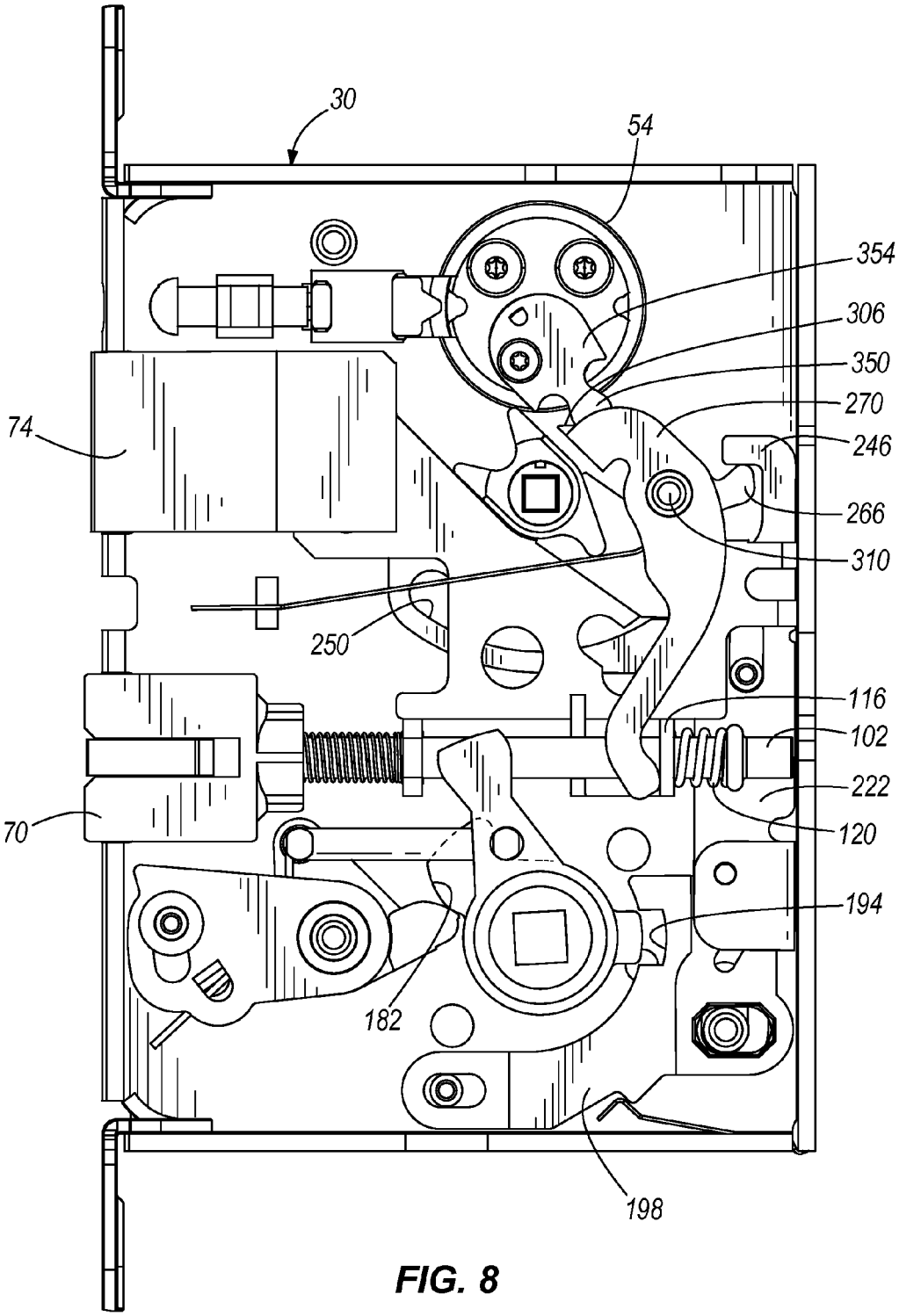
FIG. 8 is front view of the door lock of FIG. 2 in a third state.

In the third state of the door lock 30 in FIG. 8, the key is rotated counterclockwise 1.5 turns (as viewed in FIG. 9) from its locked position within the key-mechanism 54. The rotation of the key results in a clockwise (as viewed in FIG. 8) rotation of the locking member 354 of the key-mechanism 54, causing the nose 350 to engage with the inclined surface 306 of the transfer lever 270. The engagement results in a counterclockwise (as viewed in FIG. 8) rotation of the transfer lever 270 about the transfer lever pivot point 310, causing vertical movement of the lifting arm 266. The lifting arm 266 engages with the locking arm 246 to actuate vertical movement (as viewed) of the locking link 222. The vertical movement of the locking link 222 causes horizontal movement (as viewed) of the locking catch 198. The horizontal motion of the locking catch 198 disengages the outside locking lug 186 (FIG. 9) from the recess 194, thus unlocking the outside connecting link 182 by allowing the outside connecting link 182 to freely rotate. At the same time, the lifting arm 266 of the transfer lever 270 rotates counterclockwise (as viewed in FIG. 8) and engages with the actuating tab 116 of the throw rod 102 to overcome the bias of the locating spring 120 and retract the latchbolt 70. FIG. 8 shows the deadbolt 74 and the latchbolt 70 in retracted positions and the outside connecting link 182 in an unlocked position.

FIG. 9 illustrates an outside perspective view of the door lock 30 in the second position (70 degree thumbturn) as shown in FIGS. 2 and 4. The thumbturn 42 is rotated 70 degrees from the 0 degree first position, the deadbolt 74 is in a refracted position, and the latchbolt 70 is in a thrown position. The outside locking lug 186 is engaged with the recess 194 of the locking catch 198, and thus the outside connecting link 182 remains in a locked position.

Various features and advantages of the invention are set forth in the following claims.

We claim:

1. A door lock including a deadbolt and a latchbolt each movable between a thrown position and a refracted position, the lock comprising:

an inside lever operable to move the latch bolt between the thrown position and the retracted position;

an outside lever configured in one of a locked state and an unlocked state in which the outside lever is operable to move the latchbolt between the thrown and the retracted position;

a thumbturn coupled to the deadbolt and movable between a first position in which the deadbolt is in the thrown position, the latchbolt is in the thrown position, and the outside lever is locked, a second position in which the deadbolt is in the retracted position, the latchbolt is in the thrown position, and the outside lever is locked, and a third position in which the deadbolt is in the retracted position, the latchbolt is in the thrown position, and the outside lever is unlocked; and a key-mechanism positioned on an outer side of the door and movable to transition the lock between a first state, a second state, and a third state, and wherein in the first state, the deadbolt is in the thrown position, the latchbolt is in the thrown position, and the outside lever is locked, in the second state the deadbolt is in the retracted position, the latchbolt is in the thrown position, and the outside lever is locked, and in the third state the deadbolt is in the retracted position, the latchbolt is in the retracted position, and the outside lever is unlocked.

2. The door lock of claim 1, wherein the thumbturn defines a thumbturn axis, and wherein rotation of about 70 degrees from the first position positions the thumbturn in the second position.

3. The door lock of claim 2, wherein further rotation of about 20 degrees from the second position positions the thumbturn in the third position.

4. The door lock of claim 1, wherein the lock is in the first state when the thumbturn is in the first position, and wherein movement of the key-mechanism from a first position to a second position transitions the lock from the first state to the second state.

5. The door lock of claim 4, wherein further movement of the key-mechanism from the second position to a third position transitions the lock from the second state to the third state.

6. The door lock of claim 5, wherein rotation of the key-mechanism in a first direction about a key axis of about 360 degrees moves the key-mechanism from the first position to the second position.

7. The door lock of claim 6, wherein further rotation of the key-mechanism in the first direction about the key axis of about another 180 degrees moves the key-mechanism from the second position to the third position.

8. A door lock for a door including a deadbolt and a latchbolt each movable between a thrown position and a refracted position, the lock comprising:

an inside lever positioned on an inner side of the door and operable to move the latchbolt between the thrown position and the retracted position;

an outside lever positioned on an outer side of the door and configured in one of a locked state and an unlocked state in which the outside lever is operable to move the latchbolt between the thrown and the retracted position;

a key-mechanism positioned on the outer side of the door and movable to transition the lock between a first state, a second state, and a third state, and wherein in the first state, the deadbolt is in the thrown position, the latchbolt is in the thrown position, and the outside lever is locked, in the second state the deadbolt is in the retracted position, the latchbolt is in the thrown position, and the outside lever is locked, and in the third state the deadbolt is in the retracted position, the latchbolt is in the retracted position, and the outside lever is unlocked; and a thumbturn movable from a first position to a second position when the lock is in the third state to transition the outside lever from unlocked to locked.

9. The door lock of claim 8, wherein rotation of about 20 degrees from the second position positions the thumbturn in the third position.

10. The door lock of claim 8, wherein the key-mechanism is rotatable about a key axis between a first position in which the lock is in the first state, a second position in which the lock is in the second state, and a third position in which the lock is in the third state.

11. The door lock of claim 10, wherein rotation of the key-mechanism in a first direction about the key axis of about 360 degrees moves the key-mechanism from the first position to the second position.

12. The door lock of claim 11, wherein further rotation of the key-mechanism in the first direction about the key axis of about another 180 degrees moves the key-mechanism from the second position to the third position.

13. A door lock for a door having an inside and an outside, the door lock comprising:

a deadbolt movable between a thrown position and a retracted position;

a latchbolt movable between a thrown position and a retracted position;

a key-mechanism rotatable about a key axis;

a thumbturn positioned on the inside of the door and movable between a first position, a second position, and a third position;

an inside lever positioned on the inside of the door and operable to move the latch bolt between the thrown position and the retracted position;

an outside lever positioned on the outside of the door and configured in one of a locked state in which the lever cannot move the latchbolt and an unlocked state in which the outside lever is operable to move the latch bolt between the thrown and the retracted position;

wherein the lock is configurable in one of a first state in which the deadbolt is thrown, the latchbolt is thrown, and the outside lever is locked, a second state, in which the deadbolt is retracted, the latchbolt is thrown, and the outside lever is locked, a third state, in which the deadbolt is retracted, the latchbolt is thrown, and the outside lever is unlocked, and a fourth state, in which the deadbolt is retracted, the latchbolt is retracted, and the outside lever is unlocked, and wherein with the key-mechanism in a first position, movement of the thumbturn from the first position to the second position transitions the lock from the first state to the second state, and movement of the thumbturn from the second position to the third position transitions the lock from the second state to the third state, and wherein with the thumbturn in the first position, rotation of the key-mechanism a first distance transitions the lock from the first state to the second state, and further rotation of the key-mechanism transitions the lock from the second state to the fourth state.

* * * * *